US006158599A

United States Patent [19]

Lazarus

[11] Patent Number: 6,158,599

[45] Date of Patent: Dec. 12, 2000

[54] QUICK CONNECT SHELVING ASSEMBLY SYSTEM

[76] Inventor: Abraham M. Lazarus, Rehov Sachlav 52A Ramat Poleg, Netanya 42207, Israel

[21] Appl. No.: 09/225,782

[22] Filed: Jan. 5, 1999

[30] Foreign Application Priority Data

Mar. 4, 1998 [IL] Israel ..... 123552

[51] Int. Cl.[7] ..... A47F 5/08; A47B 57/52

[52] U.S. Cl. ..... 211/90.01; 211/187

[58] Field of Search ..... 211/90.01, 90.03, 211/90.04, 187, 90.02; 248/235, 247, 248, 250, 243; 403/42, 49, 287, 309, 335, 338; 108/64, 69, 106, 107, 108, 147.13, 147.14, 147.17, 192, 193

[56] References Cited

U.S. PATENT DOCUMENTS

| | | | |
|---|---|---|---|
| 919,526 | 4/1909 | Belcher | 108/108 |
| 2,956,688 | 10/1960 | Galassi | 108/108 |
| 3,128,074 | 4/1964 | Schwarz | 248/246 |
| 3,229,648 | 1/1966 | Hobson | 108/147.17 |
| 4,360,181 | 11/1982 | Burkholder | 248/248 |
| 4,423,817 | 1/1984 | Monjo-Rufi | 211/187 |
| 4,444,322 | 4/1984 | Lee | 211/187 X |
| 5,279,430 | 1/1994 | Benton | 211/187 X |
| 5,425,520 | 6/1995 | Masumoto | 248/247 |
| 5,810,179 | 9/1998 | Kleinman | 211/90.03 X |

*Primary Examiner*—Daniel P. Stodola
*Assistant Examiner*—Erica B. Harris
*Attorney, Agent, or Firm*—Edward Langer

[57] ABSTRACT

A shelving support system using a locking tab and aperture arrangement, in which an upright member is provided with a pair of rhombic-shaped apertures formed one above the other, each aperture being oriented at 45 degrees to the vertical. The pair of apertures engages a pair of tabs protruding from a shelf support, with orientation matching the apertures, to maintain locking engagement by developing oppositely-directed forces on the tabs, when the support is attached to the upright in cantilever fashion. The attachment is achieved by engagement of the tabs in the apertures first, and then the support is locked via combined horizontal and vertical, diagonally-directed motion. The 45 degree orientation of the apertures enables the upright members to be left and/or right handed, since the reverse side of the apertures is a mirror-image, so that the shelf supports are attachable on this side also, thus reducing the total number of individual components needed for system assembly. Loading of the shelf develops oppositely-directed forces on the tabs at the aperture edges, with the oppositely-directed forces acting edge-on on the edges of the self-locking tabs in each aperture, in shear, insuring a very high overall system load capability.

21 Claims, 19 Drawing Sheets

QUICK CONNECT SHELVING ASSEMBLY SYSTEM

FIELD OF THE INVENTION

The present invention relates to shelving systems as may be used in wall-mounted systems, free-standing types and the like, and more particularly, to a quick-connect shelving assembly system having diagonally-oriented shelf tabs which engage diagonally-oriented holes in a wall bracket or support, with a sliding downward motion to insure locking engagement.

BACKGROUND OF THE INVENTION

The variety of known shelving assemblies is very large, but there is a continuing need for simplification and fewer mass-produced parts in order to realize the benefits of reduced costs, and more convenient assembly according to wide variety of possible designs, featuring a sturdy construction.

Shelving systems are typically provided as knock-down kits for assembly at the user's location, thus saving shipping costs by avoiding the need to transport bulky assemblies. The user is then faced with the task of assembly, which is a major problem, due to his lack of familiarity with the assembled design, and the need to locate the identify a multitude of parts and to follow generally poor assembly instructions in the package. Complicated prior art designs only increase the problem, and these do not lend themselves to quick, easy construction.

Sheetmetal shelving systems using a clip and hole method of assembly are known, including the system described in British patent No. GB 2281193 to Silver Lynx, illustrating the use of tabs interlocking into holes, for supporting shelf brackets.

European patent EP 0639342 to Schneider describes a framework for supporting shelving having angled tabs fitting into open-ended apertures formed on a crosspiece which is joined to an upright section. The apertures are also angled, developing a wedge action which draws the crosspiece into position where it firmly abuts the back wall of the upright. However, since the apertures are open-ended, the tabs are not locked therein and the crosspiece would become separated. In a wall-shelf arrangement, mounting of shelves in cantilever fashion would not be possible since the angled tabs would ride up out of the open-ended apertures, or they may be disengaged if knocked from underneath.

The marketing trend to distribute building materials for construction projects via do-it-yourself home supply centers has increased the consumer demand level for easy to assemble products. In general, existing shelving systems do not meet this need due to their complexity and intricate parts and fittings.

Therefore, it would be desirable to provide a quick and easy to assemble shelving system with maximum layout flexibility.

SUMMARY OF THE INVENTION

Accordingly, it is a principal object of the present invention to overcome the above-mentioned disadvantages of prior art shelving systems, and provide a quickly and easily assembled shelving support system using a locking tab and hole arrangement.

In accordance with a preferred embodiment of the present invention, there is provided a shelving assembly system comprising:

an upright member defining a vertical support having formed therein at least a first connecting means, and at least one shelf support having formed on its side face at least a second connecting means shaped to engage said first connecting means in locking fashion for supporting a shelf end thereon, wherein said first and second connecting means are oriented at an angle with respect to said upright member, said angle guiding engagement therebetween by combined horizontal and vertical motion.

In the preferred embodiment, the upright member is provided with a pair of rhombic-shaped apertures formed one above the other, each aperture being oriented at 45 degrees to the vertical. The pair of apertures engages a pair of tabs protruding from a shelf support, with orientation matching the apertures, to maintain locking engagement by developing oppositely-directed forces on the tabs, when the support is attached to the upright in cantilever fashion. The attachment is achieved by engagement of the tabs in the apertures first, and then the support is locked via combined horizontal and vertical, diagonally-directed motion.

The 45 degree orientation of the apertures enables the upright members to be left and/or right-handed, since the reverse side of the apertures is a mirror-image, so that the shelf supports are attachable on this side also, thus reducing the total number of individual components needed to system assembly.

In accordance with the principles of the present invention, the shelf support is self-locking. Since the apertures are formed with a 45 degree orientation, a diagonally-directed motion is required to attach the shelf support to the upright. This diagonally-directed motion insures that, in relation to the upright, no vertical motion of the shelf support is possible, thus maintaining the shelf locked in position on the upright, with respect to the vertical direction.

Loading of the shelf develops oppositely-directed forces on the tabs at the aperture edges, one directed upwards and one directed downwards. The strength of the shelf support system relies on the fact that the oppositely-directed forces act edge-on on the edges of the self-locking tabs in each aperture. Thus, the strength of the tabs in shear, rather than their resistance to bending, is what supports the shelf load, insuring a very high overall system load capability.

The inventive design and inherent system strength facilitates the use of light-gauge sheet metal for manufacture of the shelf supports for individual shelves.

The inventive design features a sturdy, easily constructed shelving support system for homes, stores and offices.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

DETAILED DESCRIPTION OF THE PREFERRED EMBODIMENTS

Figure 1A:
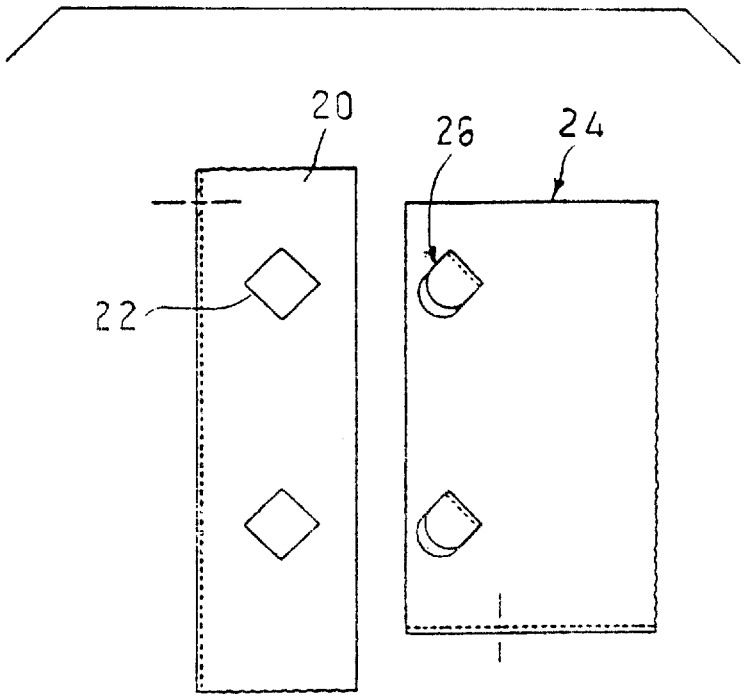
FIGS. 1*a–f* illustrate a preferred embodiment of a quick-connect shelving assembly system constructed in accordance with the principles of the present invention.
Figure 1B:
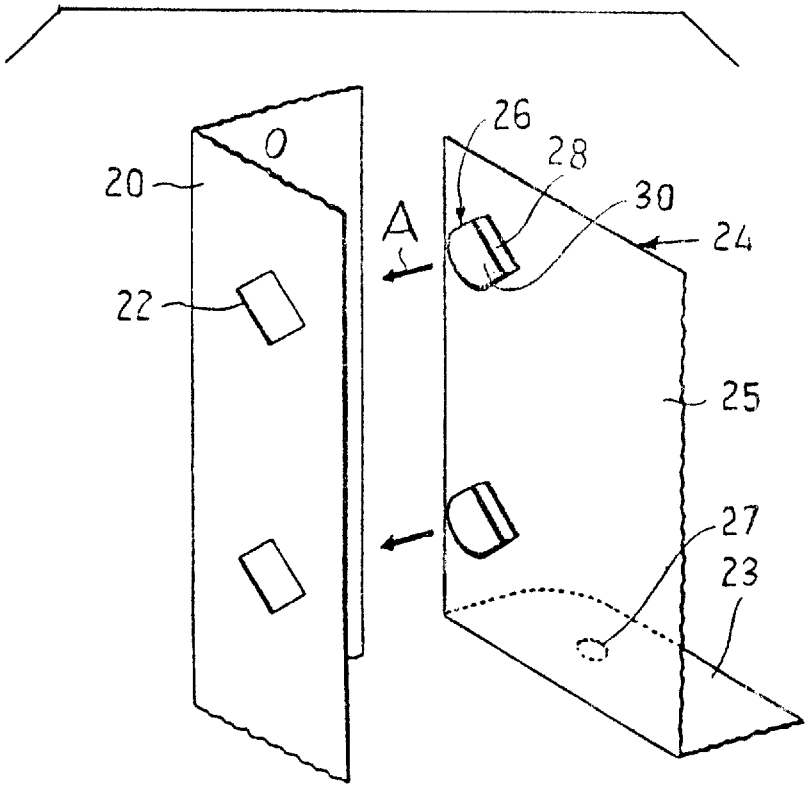

Referring now to FIGS. 1*a–f,* there are shown side and perspective views of a preferred embodiment of a quick-connect shelving assembly system constructed in accordance with the principles of the present invention. In FIGS. 1*a–b,* an upright member 20, typically an L-shaped wall bracket, is shown formed with a pair of apertures 22, typically punched out of member 20, with apertures 22 oriented at 45 degrees to the vertical. A shelf support bracket 24 is formed with a horizontal ledge 23 having a hole 27 for mounting a shelf (not shown) thereon. Shelf support 24 is formed on its vertical face 25 with a pair of tabs 26, each shaped with a projecting shoulder portion 28 and a portion 30 parallel to its face 25.

Figure 1C:
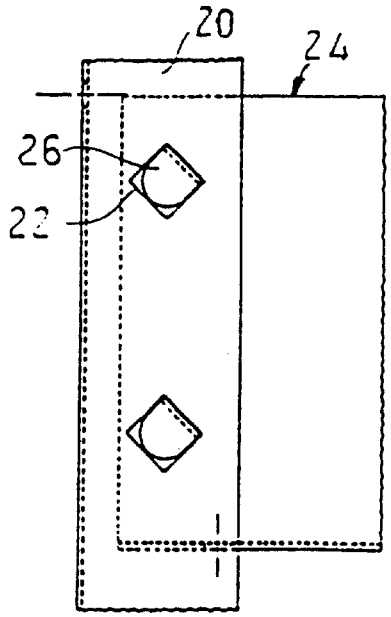
Figure 1D:
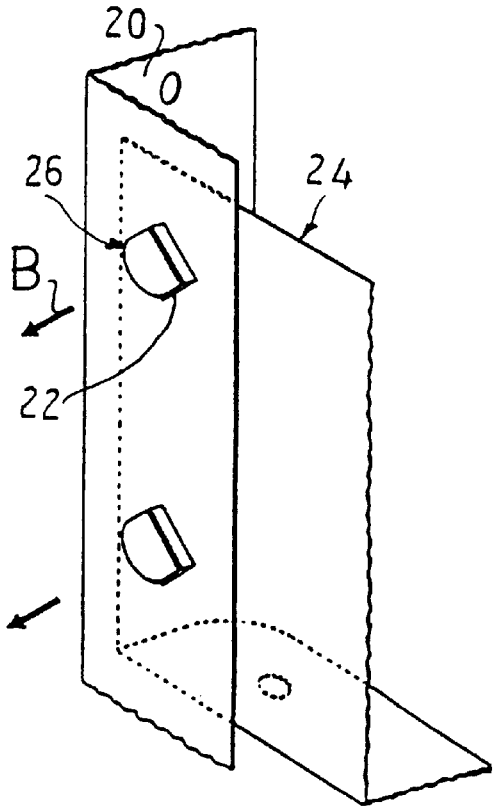
Figure 1E:
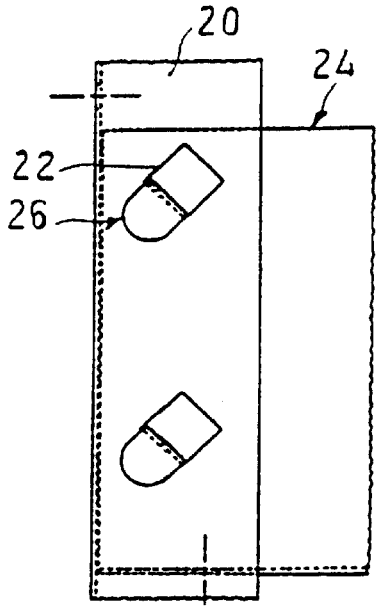
Figure 1F:
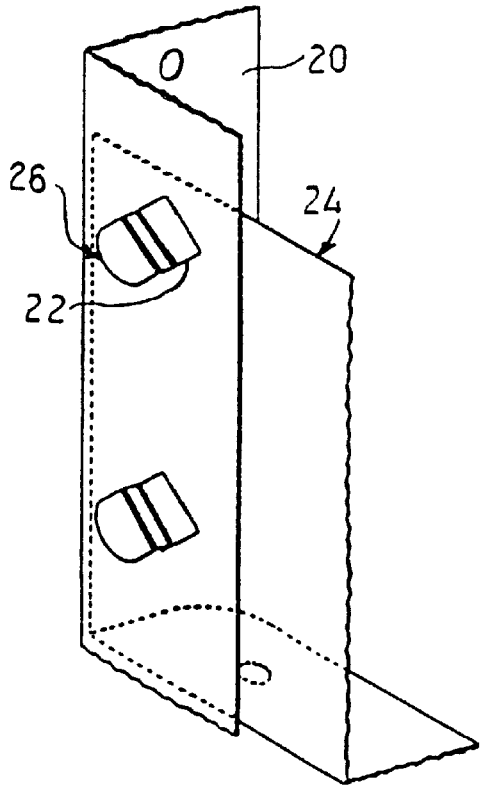

As indicated by the arrows "A" in FIG. 1*b,* to attach the shelf support bracket 24 to upright member 20, transverse planar motion of shelf support 24 enables placement of tabs 26 through apertures 22 formed in upright 20, as shown in FIGS. 1*c–d.* Once tabs 26 are so placed, shelf support 24 can be slid downwards with combined vertical and horizontal, 45 degree diagonally-directed motion (arrows "B), so that tabs 26 clip onto and engage upright member 20 at the edge of aperture 22, as shown in FIGS. 1*e–f.* Aperture 22 edge stops tab shoulder 28 and abuts it.

In FIGS. 2*a–h,* there are illustrated, respectively, side and perspective views of the exterior and interior of a shelf support 24, shown before and after attachment to upright 20. The right and left-hand views of shelf support 24 reveal a reverse symmetrical design of the tab 26 and aperture 22 layout. In the side view of shelf support 24, tabs 26 are shown formed integrally as a portion of shelf support bracket 24 material. The shape and configuration of the tab 26 is formed by pressing it out of the shelf support bracket 24 with a suitably shaped die. Alternatively, tabs 26 may be welded or riveted to shelf support 24.

The radius shape at the tip of each tab 26 is particularly suited to increasing the loading strength of the inventive shelving assembly system. This is because in pressing out tabs 26, the radius shape leaves intact more original shelf support 24 material, without affecting its strength, than would otherwise be the case if a square-shaped type of tab were formed.

As will be appreciated, the strength of materials used in the inventive shelving assembly system is designed in accordance with loading requirements, and desired shelf dimensions.

In the side view of FIGS. 2*a–d,* a gap 29 is shown between tabs 26 and the vertical face 25 of shelf support 24. When tabs 26 are fully engaged in apertures 22 of upright 20, the aperture 22 edge is gripped tightly within gap 29, limiting side-to-side movement of shelf support 24, and insuring a sturdy shelf layout.

Figure 2A:
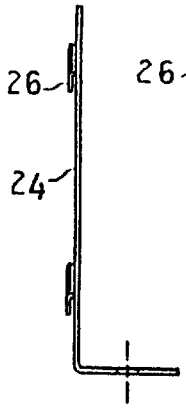
FIGS. 2*a–h* illustrate, respectively, side and perspective views of the exterior and interior of right and left-hand shelf supports.
Figure 2B:
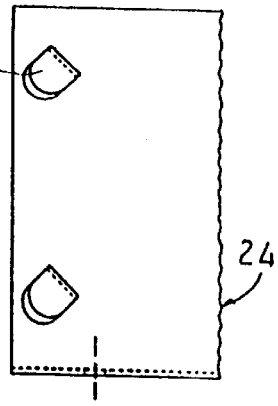
Figure 2C:
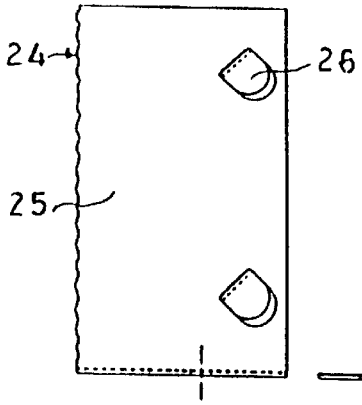
Figure 2D:
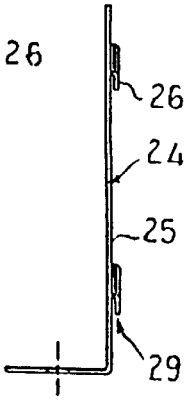
Figure 2E:
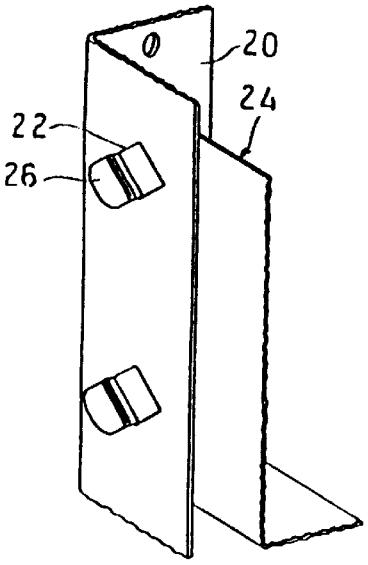
Figure 2F:
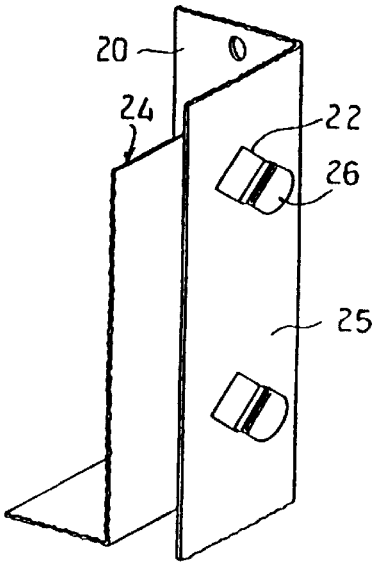
Figure 2G:
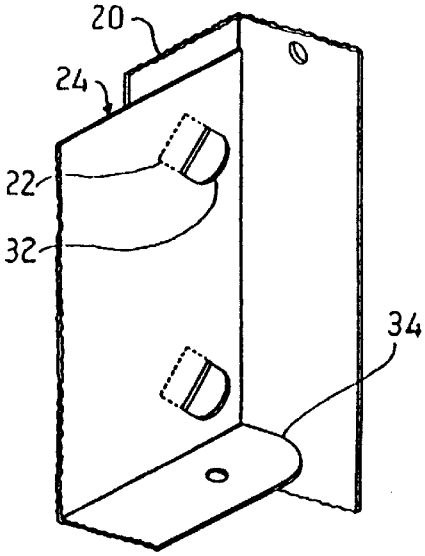
Figure 2H:
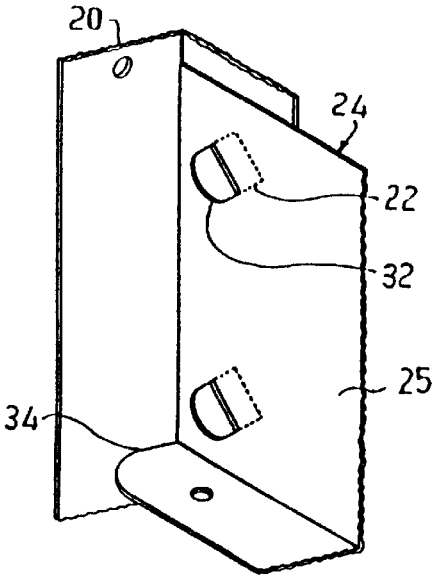

As shown in FIGS. 2*g–h,* the interior view of the attached shelf support 24 reveals the radius shape formed by the edge 32 of the removed tab 26 material. In this view, tab 26 itself is not seen as it extends behind the upright member 20 (FIGS. 2*e–f*). A portion of upright member 20 is visible in the area adjacent to the edge 32 of the material of shelf support 24 remaining after tab 26 has been pressed out. The dotted line shows the aperture 22 formed in upright 20, which is behind shelf support 24.

The interior view of FIGS. 2*g–h* also reveals rear end 34 of shelf support 24, which may provide a stop against upright 20 when it is slid diagonally downward into position against it, as an alternative to or in conjunction with the tab shoulder 28 stop.

Figure 3A:
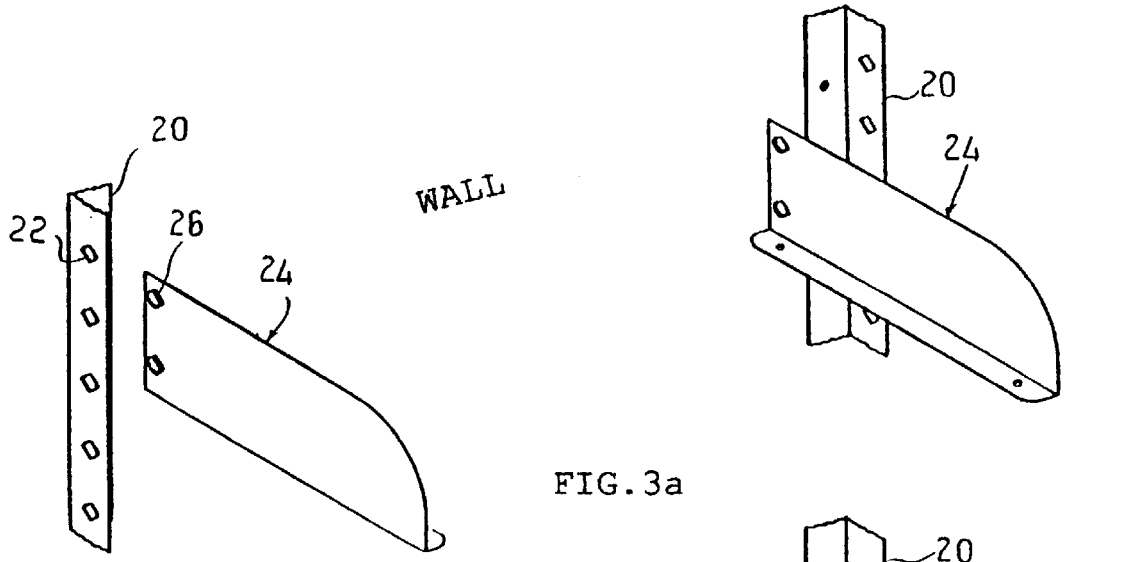
FIGS. 3*a–c* illustrate a method of construction of a 2-tab shelf support system in accordance with FIGS. 1*a–c;*
Figure 3B:
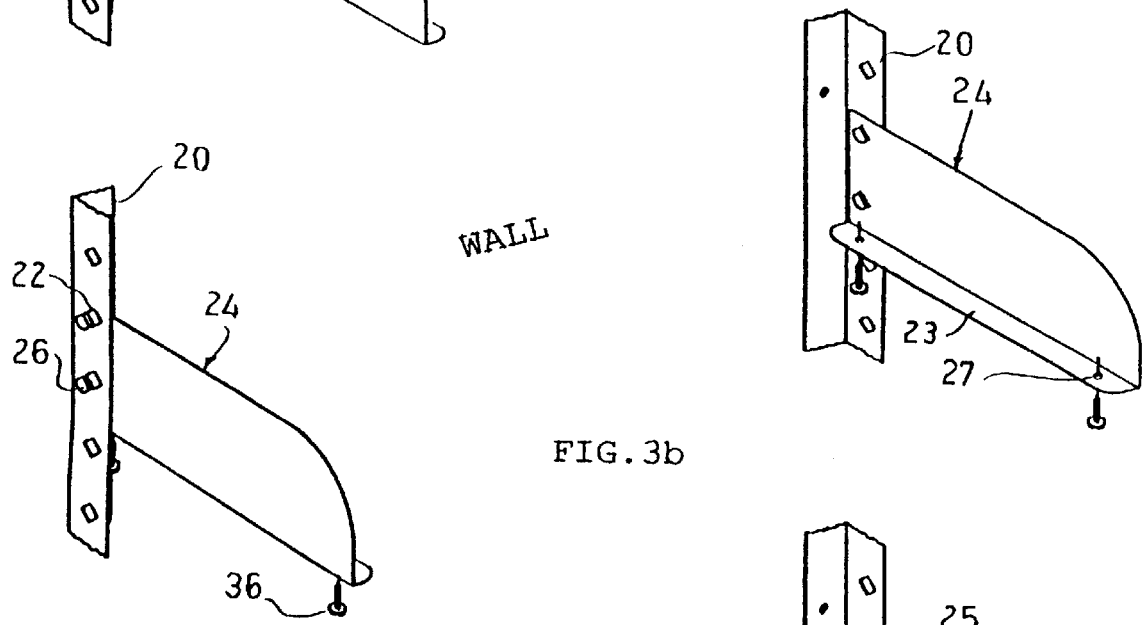
Figure 3C:
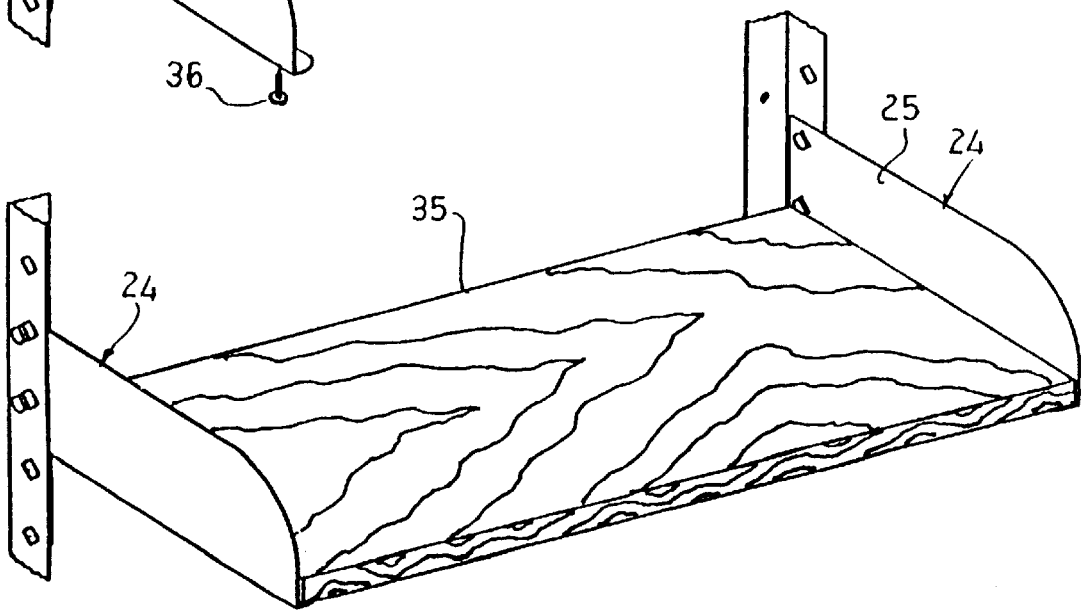

In FIGS. 3*a–c,* there is illustrated a method of construction of a 2-tab shelf support 24 per the invention. Each of a pair of oppositely-facing shelf supports 24 has its tabs 26 placed into apertures 22 on the interior of upright 20, and tabs 26 clip onto upright 20 by downward, diagonally-directed motion. As shown in FIG. 3*b,* a shelf 35 can be secured to shelf support 24 by screws 36 passing through hole 27 in its horizontal ledge 26. A wooden shelf 35 is illustrated, but other materials may be used. The vertical faces 25 of shelf supports 24 also provide book ends.

In application where shelf 35 is not rigidly secured to shelf supports 24, the absence of side-to-side movement of shelf supports 24 in relation to upright 20 minimizes their tendency to spread open, insuring the shelf 35 will not drop out.

Figure 4A:
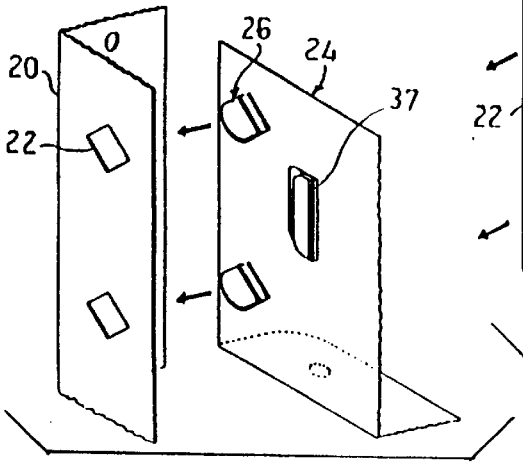
FIGS. 4*a–e* illustrate a 2-tab shelf support featuring a reinforcing clip for additional construction strength.
Figure 4B:
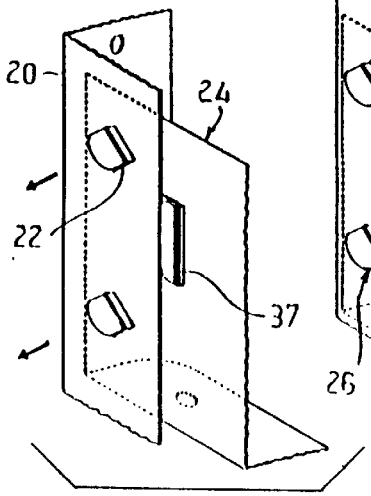
Figure 4C:
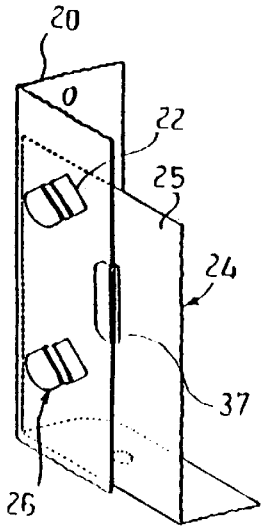

Referring to FIGS. 4*a–c,* there is shown a 2-tab shelf support featuring a reinforcing clip 37 for additional construction strength. As with tabs 26, reinforcing clip 37 projects outwardly from vertical face 25 of shelf support 24, and acts as a stop during sliding engagement of shelf support 24 with upright 20, and further limits side-to-side movement of shelf support 24 in relation to upright member 20.

Figure 4D:
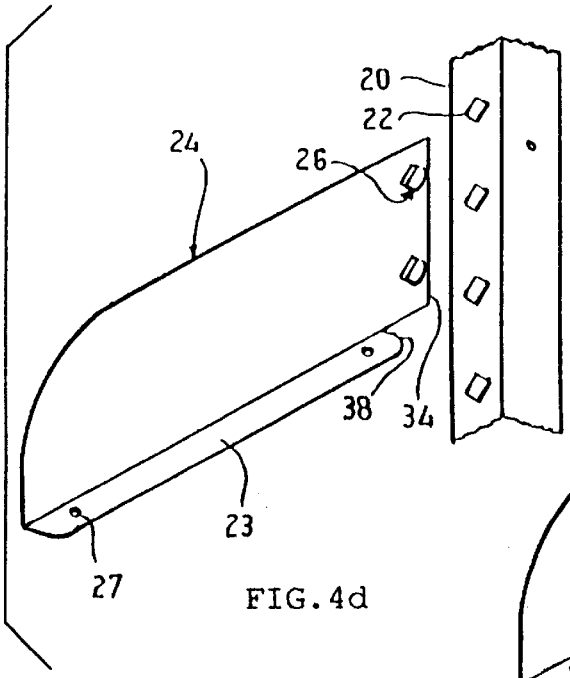
Figure 4E:
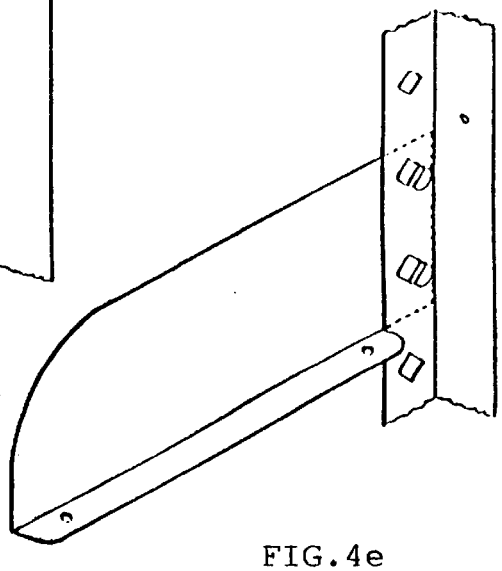

In FIGS. 4*d–e,* an exterior shelf mounting layout is shown. In this arrangement, tabs 26 are pressed out on the same side of shelf support 24 as horizontal ledge 23, facing the interior. The rear end 38 of horizontal ledge 23 is shortened by the depth of upright 20, allowing clearance for shelf support 24 rear end 34.

Figure 5A:
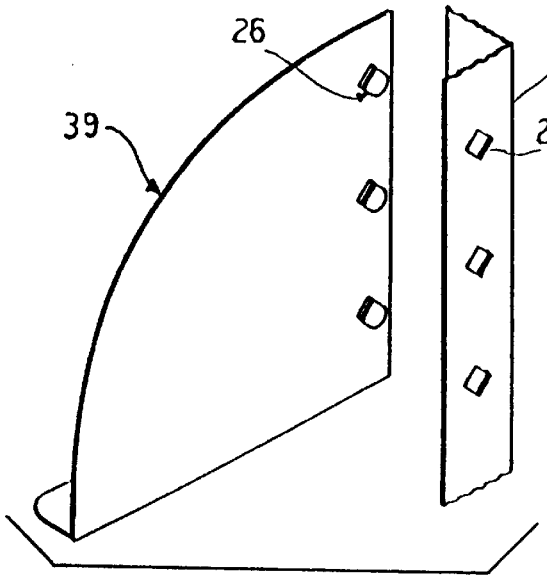
FIGS. 5*a–b* illustrate a 3-tab shelf support bracket integrally constructed with FIGS. 1*a–c;*
Figure 5B:
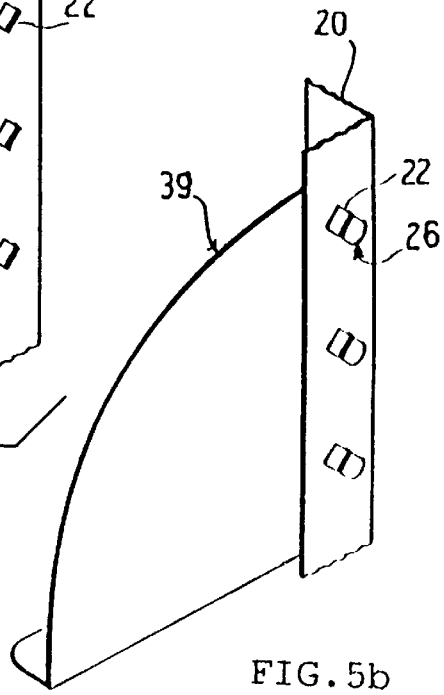
Figure 5C:
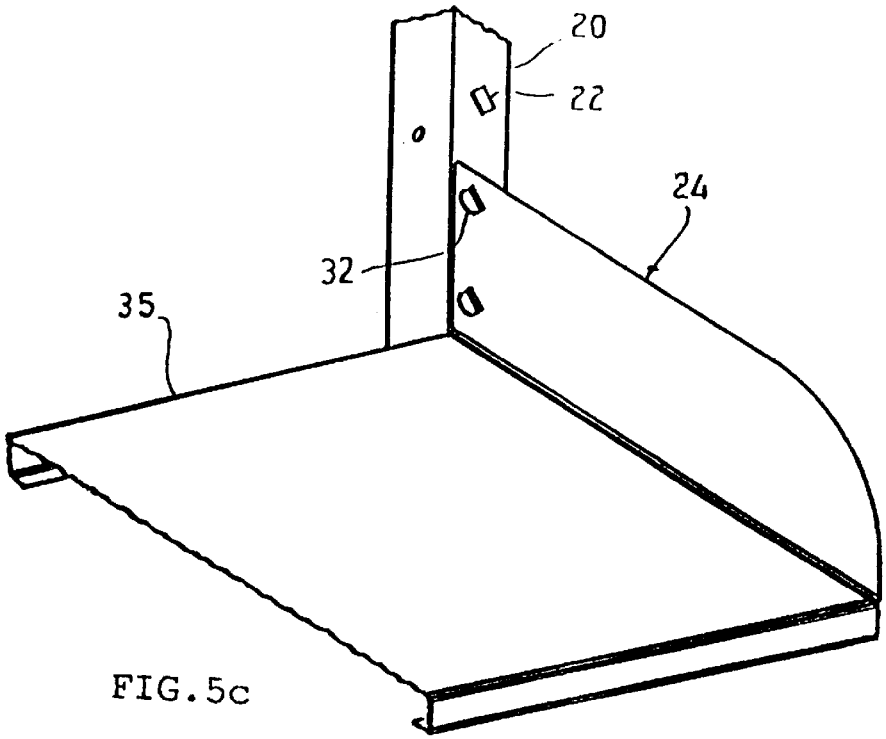
FIG. 5*c* illustrates a 2-tab shelf support bracket integrally constructed with a shelf.

In FIGS. 5*a–b,* there is shown a 3-tab shelf support constructed in accordance with FIGS. 1*a–f.* The additional tabs provide increased strength and stability to the overall design.

In FIG. 5*b,* there is shown a 2-tab shelf support bracket 24 integrally constructed with a shelf 35, simplifying the construction and enabling quick assembly of the shelving layout. Per FIGS. 2*c–h,* tab 26 extends behind upright 20 and edge 32 is seen.

Figure 6:
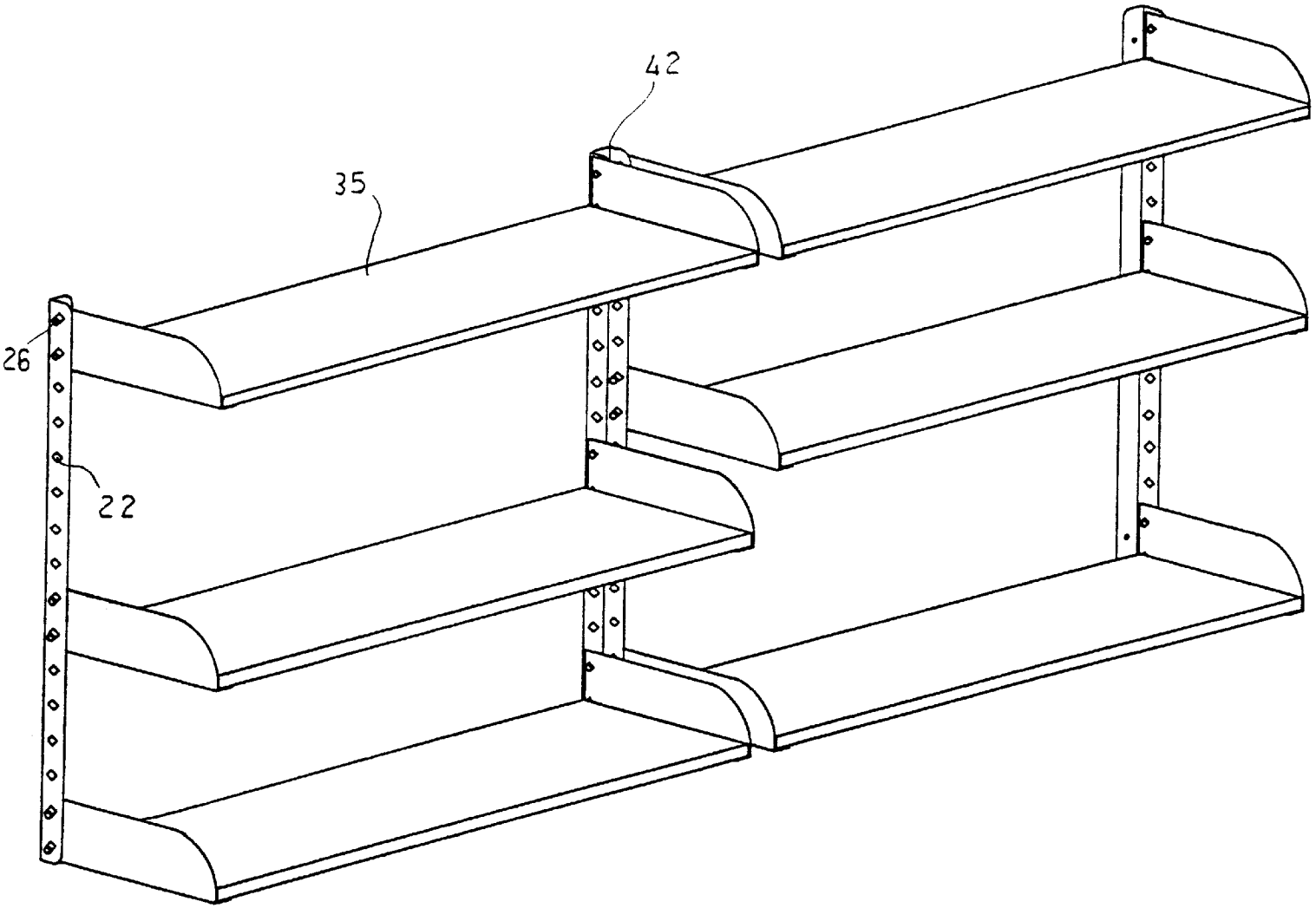
FIG. 6 illustrates a wall-mounted shelving embodiment using an intermediate double-sided upright in a staggered shelf layout.

FIG. 6 illustrates a wall-mounted shelving embodiment using a U-shaped intermediate upright 42 in a staggered shelf layout. The U-shaped upright 42 has a second vertical side formed with additional apertures 22 for attachment of shelves thereto. If the shelves 35 are mounted at the same height, this embodiment enables an overall increase in shelf length, for a continuous run.

Figure 7B:
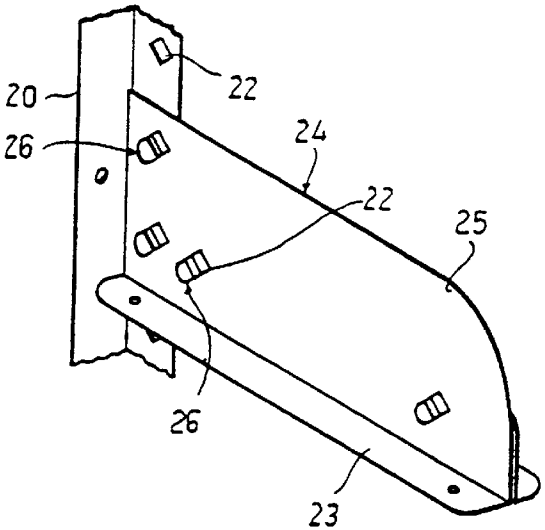
FIGS. 7*a–c* illustrate a wall-mounted shelving embodiment with an end-to-end connection between shelves for extended length.
Figure 7A:
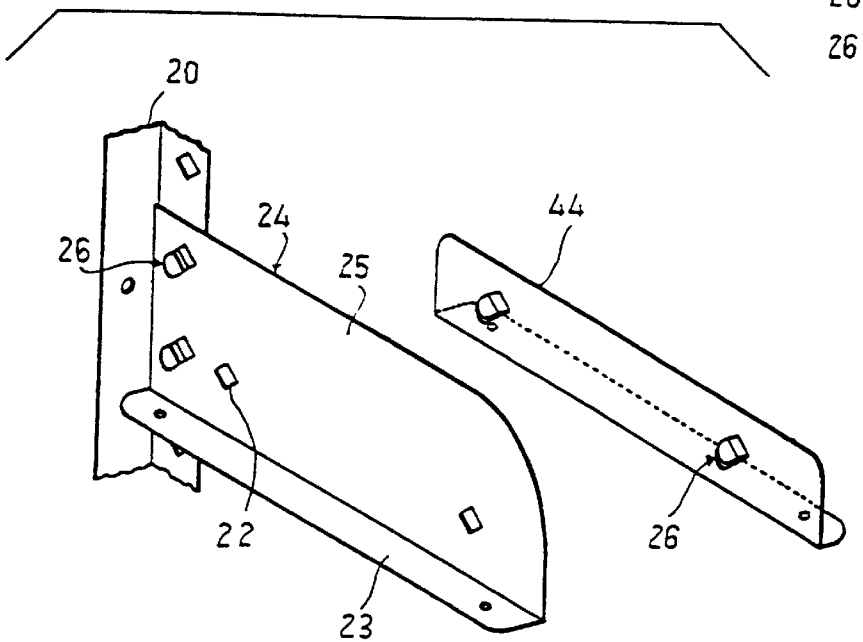
Figure 7C:
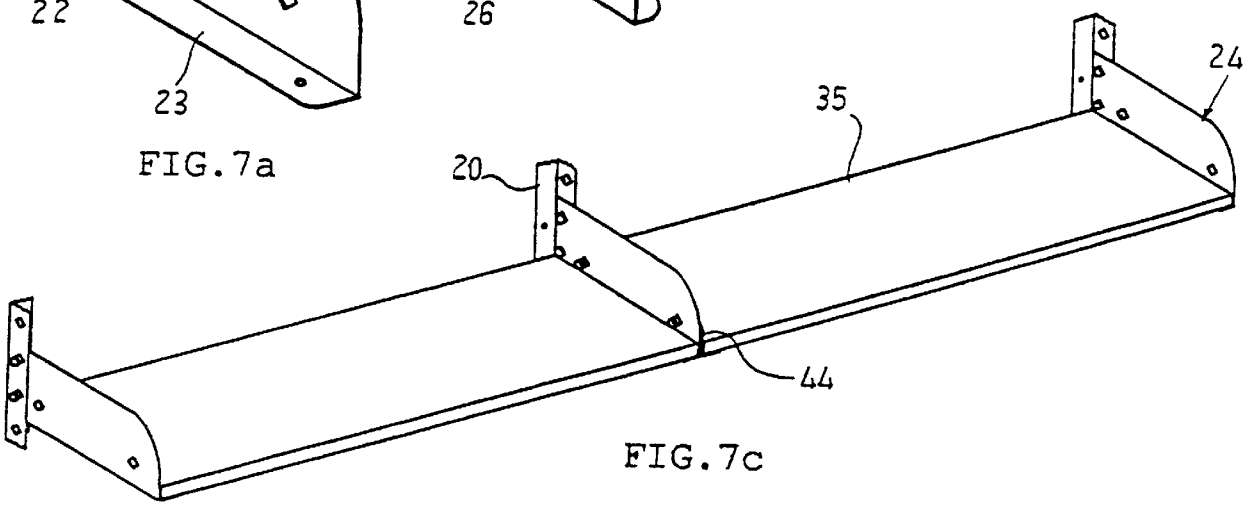

Another embodiment for increasing the overall shelf length or providing a continuous run of shelving is shown in FIGS. 7*a–c,* which illustrates a wall-mounted shelving embodiment with an end-to-end connection between shelves for extended length. In this design, shelf support bracket 24 is modified by forming apertures 22 on its vertical face 25, which engage tabs 26 formed on an intermediate shelf support bracket 44. Thus, a regular upright member 20 is used in this shelving layout.

Figure 8:
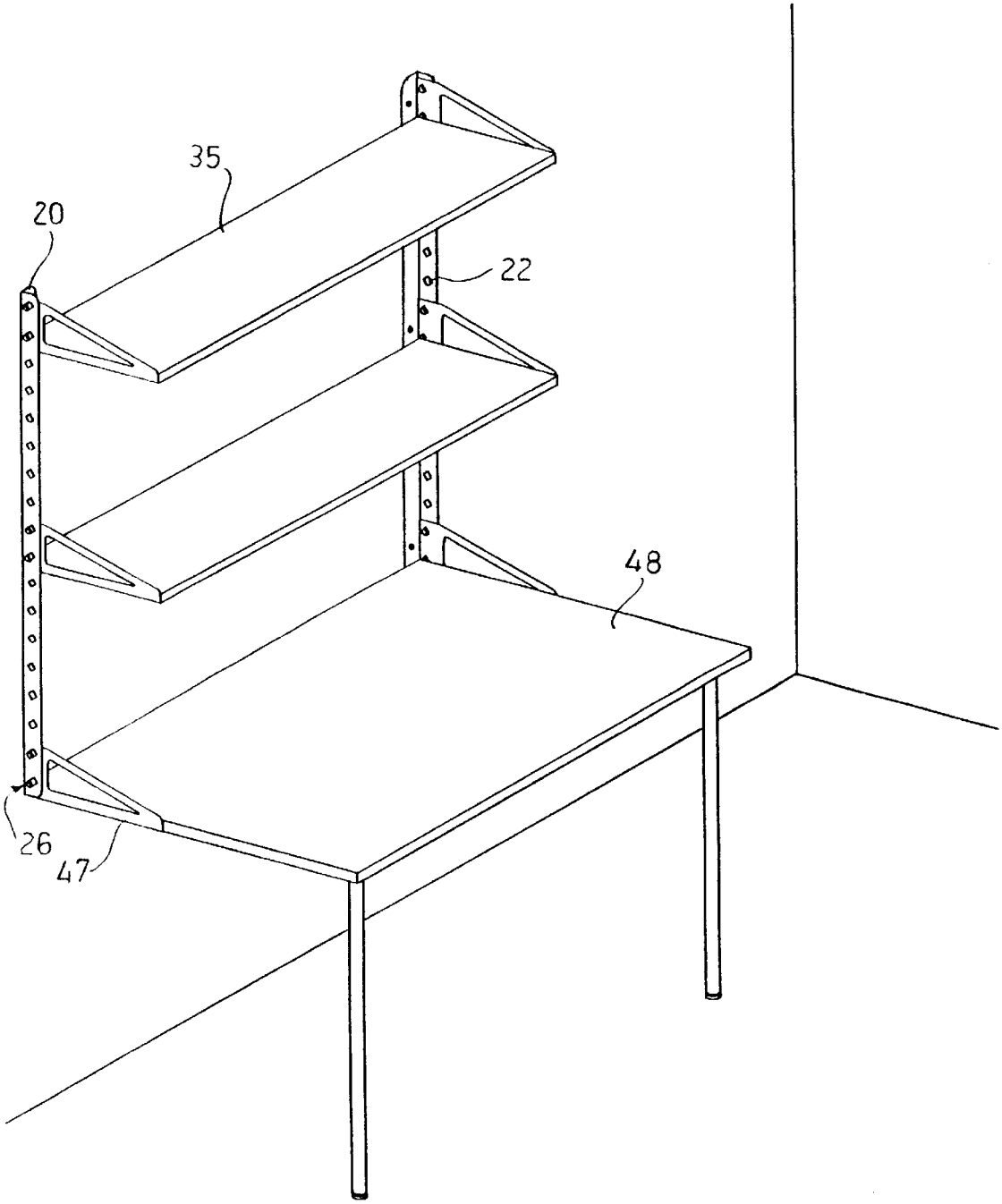
FIG. 8 illustrates a wall-mounted shelving embodiment.

FIG. 8 illustrates a wall-mounted shelving embodiment. In this design, shelf support 24 are replaced by shelf support brackets 47, which are streamlined with open sides, providing a simpler look. A table top 48 may be supported as a shelf, to make a complete desk and shelf arrangement, for use in home or office.

As will be appreciated, the vertical profile of shelf support bracket 24 can be designed as desired to give, for example, a contemporary, modern or traditional look.

Figure 9:
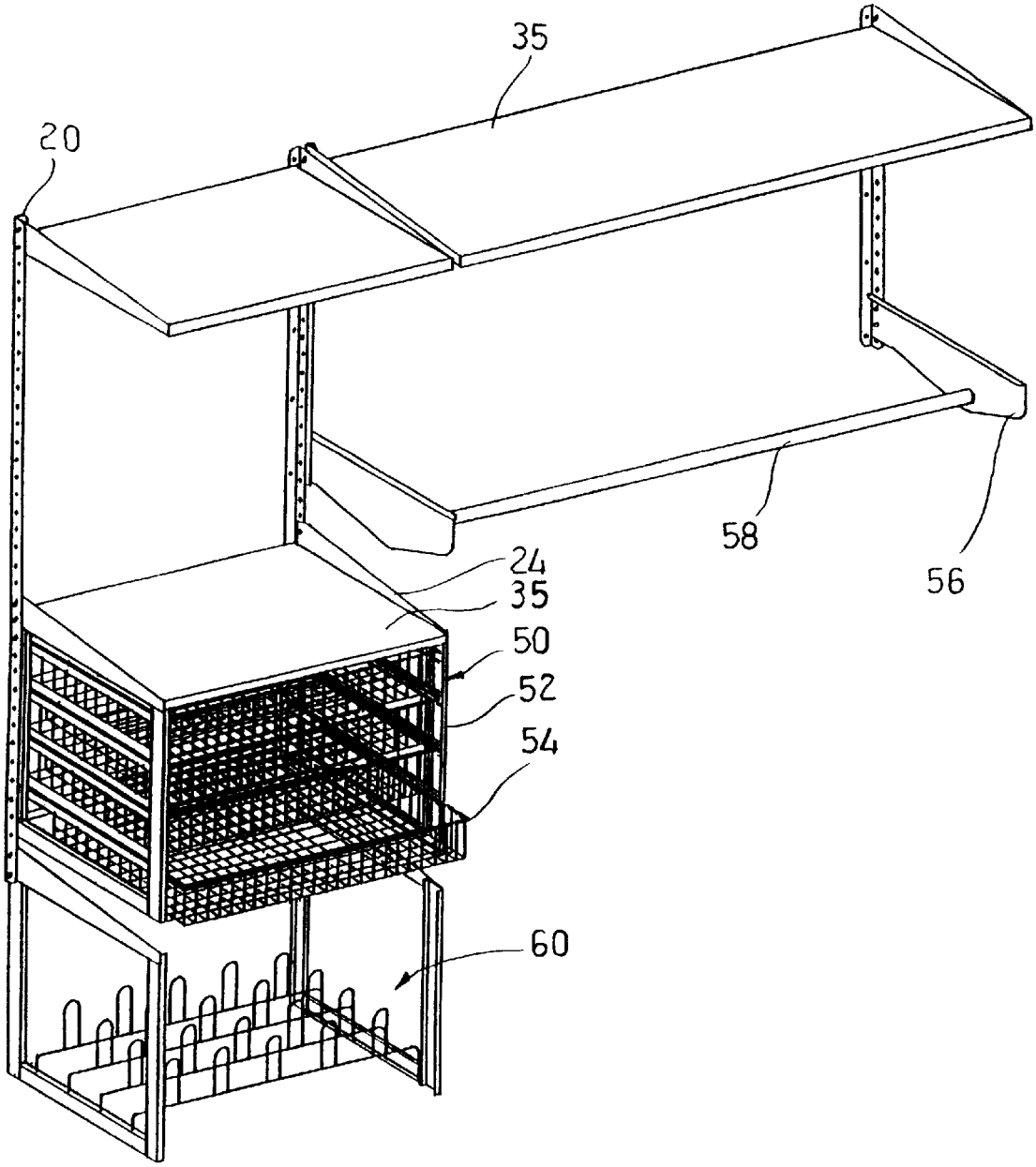
FIG. 9 illustrates an embodiment for use as a closet organizer system.

FIG. 9 illustrates an embodiment for use as a closet organizer system. In this arrangement, specific components are designed for covenient storage of clothing, shoes, and other personal items. A modular unit 50 can be provided with a frame 52 having slidable drawers 54 mounted underneath shelf 35, with unit 50 supported by shelf supports 24. Another set of modified shelf supports 56 can be modified to support a clothes hanger bar 58. A shoe rack 60 can be supported by another set of shelf supports 24. For efficient closet space utilization, upright member 20 can be produced in any length required.

Figure 10C:
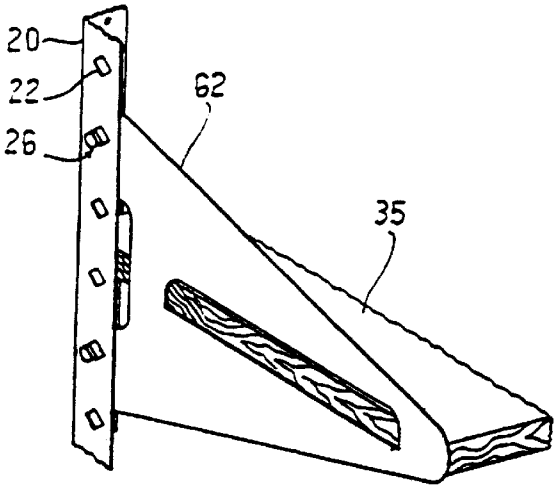
FIGS. 10*a–c* illustrate a shelf support constructed for increased loading.
Figure 10B:
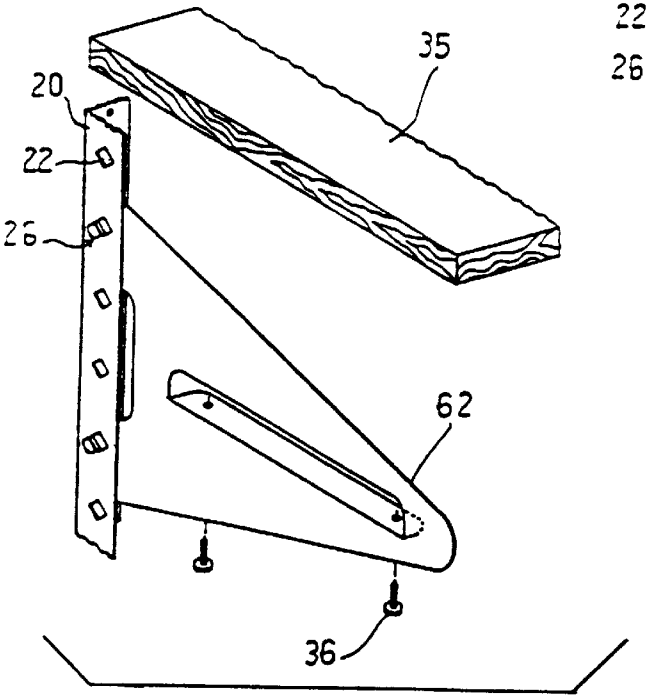
Figure 10A:
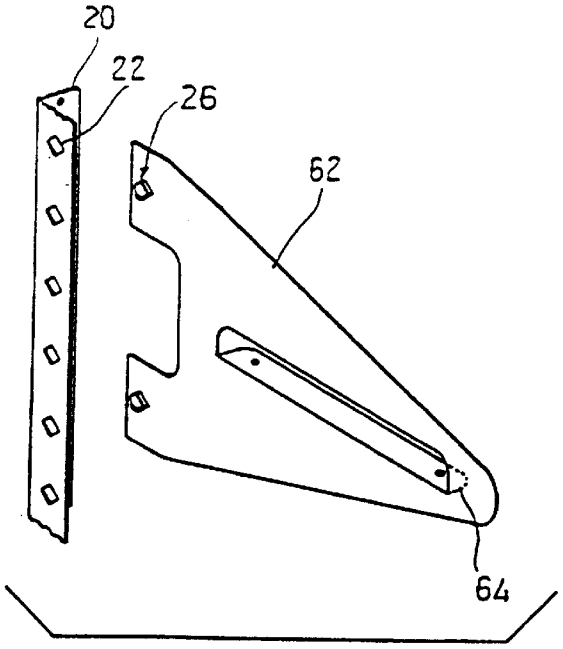

FIGS. 10*a–c* illustrate a shelf support constructed for increased loading. In this design, shelf supports 24 are replaced by winged support brackets 62 which are adapted for use with spaced apart apertures 22 which are non-adjacent to one another. The horizontal edge 64 of this bracket 62 is formed between the top and bottom tabs 26.

Figure 11A:
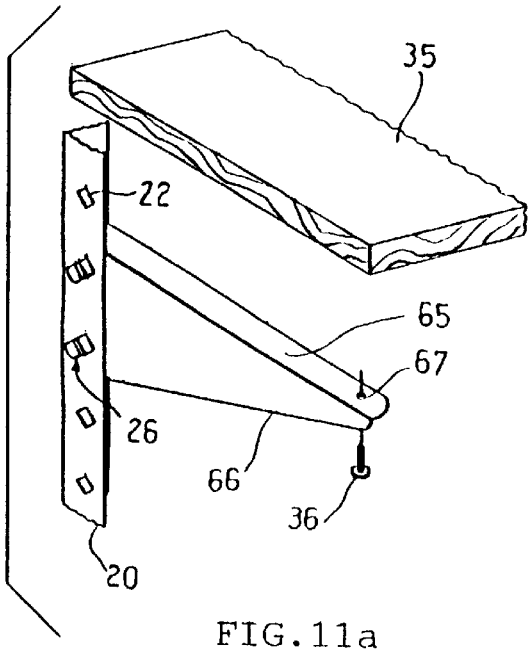
FIGS. 11*a–b* illustrate an inverted shelf support edge.
Figure 11B:
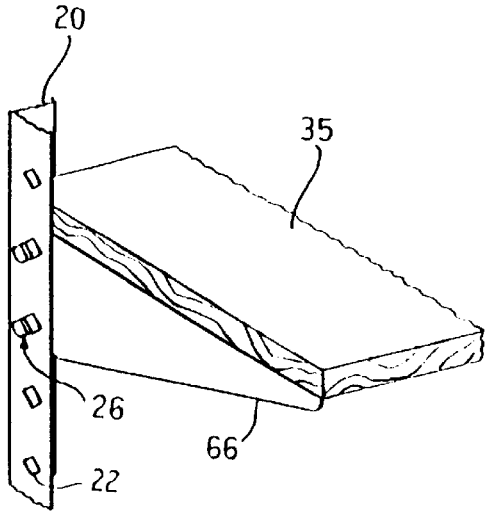

FIGS. 11*a–b* illustrate an inverted shelf support edge 65, provided by inverted shelf support bracket 55, over which shelf 35 is overlaid, and attached using screw 36 through hole 67.

Figure 12A:
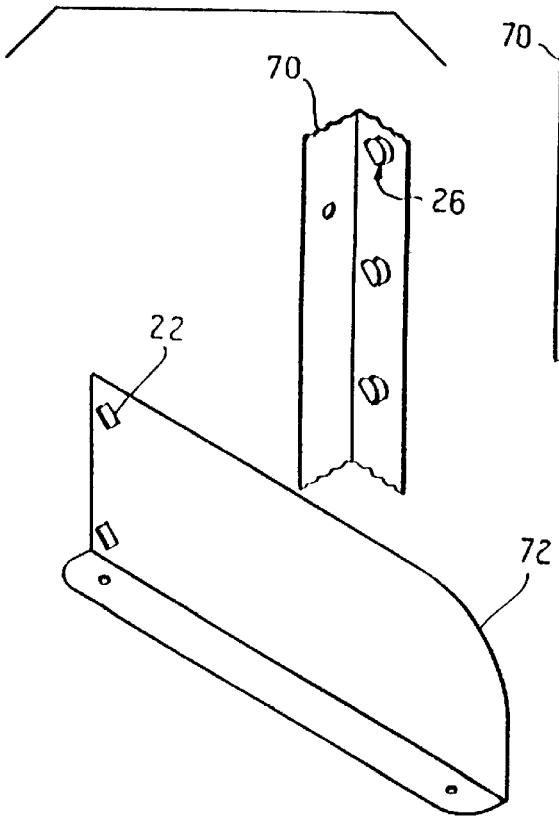
FIGS. 12*a–b* illustrate a set of reversed tabs and apertures.
Figure 12B:
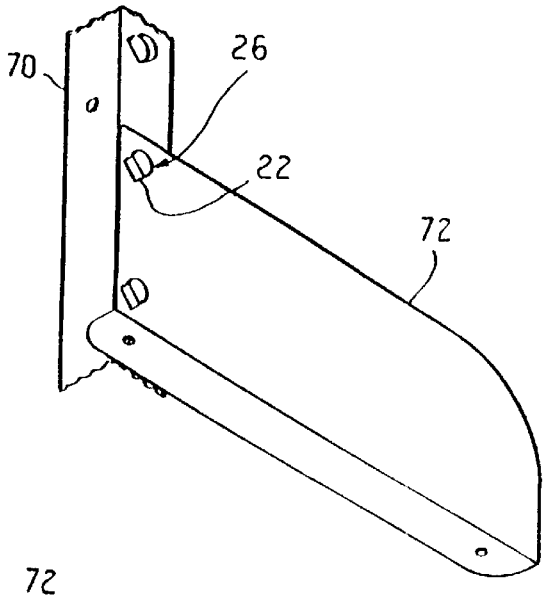

FIGS. 12*a–b* illustrate an alternative embodiment featuring a set of reversed tabs and apertures, wherein tabs 26 are formed on upright member 70, and apertures 22 in shelf support bracket 72.

Figure 13A:
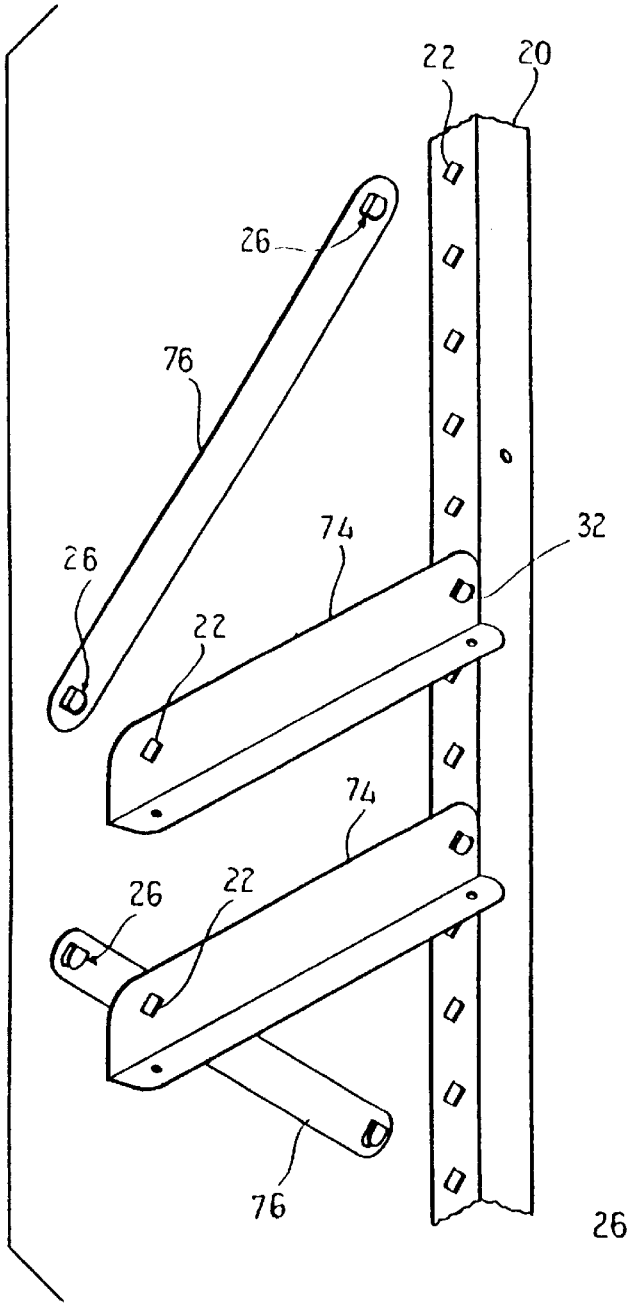
FIGS. 13*a–b* illustrate a shelf support and bracing arm.
Figure 13B:
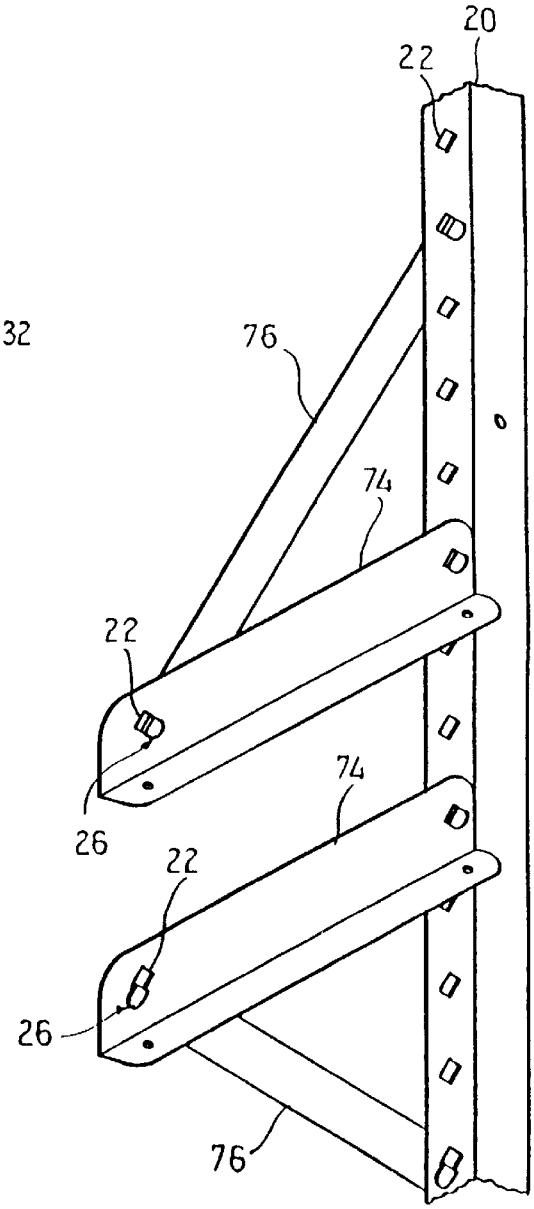

FIGS. 13*a–b* illustrate a shelf support bracket 74 formed with an aperture 22 at its front end, for engaging a tab 26 provided at one end of a bracing arm 76, having at its other end a tab 26 engaging upright member 20. Bracing arm 76 provides additional strength, increasing shelving system load capability, either by providing support from above, or underneath the shelf. As in FIGS. 2*c–h,* tab 26 at the rear of shelf support 74 is not seen as it extends behind the upright member 20, but edge 32 is seen.

Figure 14B:
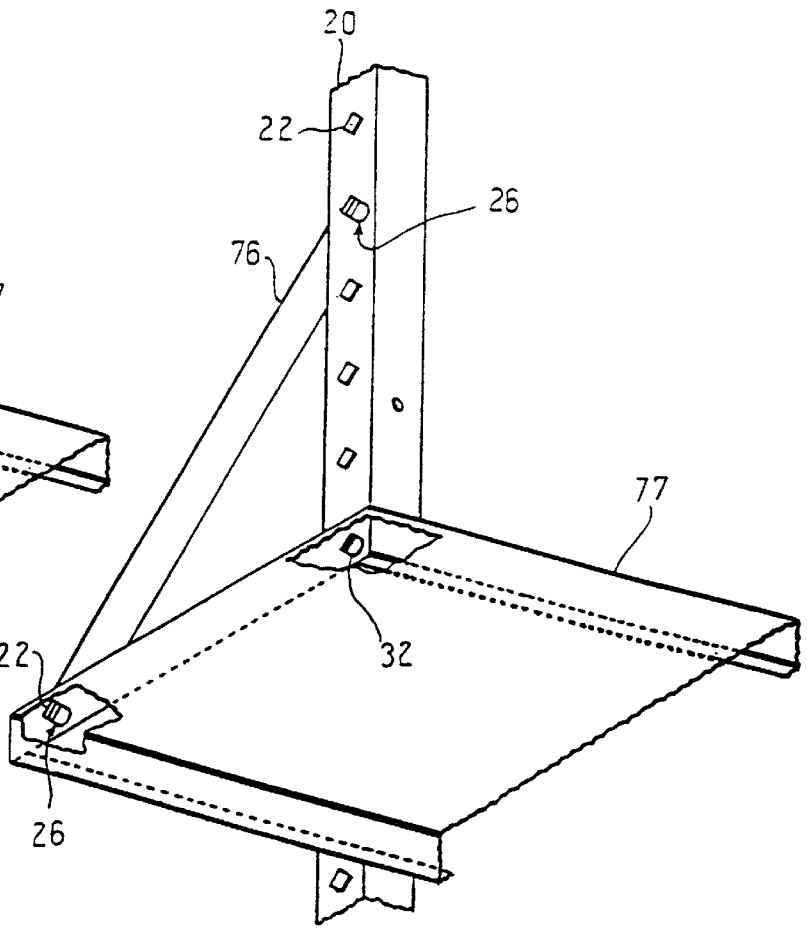
FIGS. 14*a–b* illustrate a shelf with integrally formed tabs.
Figure 14A:
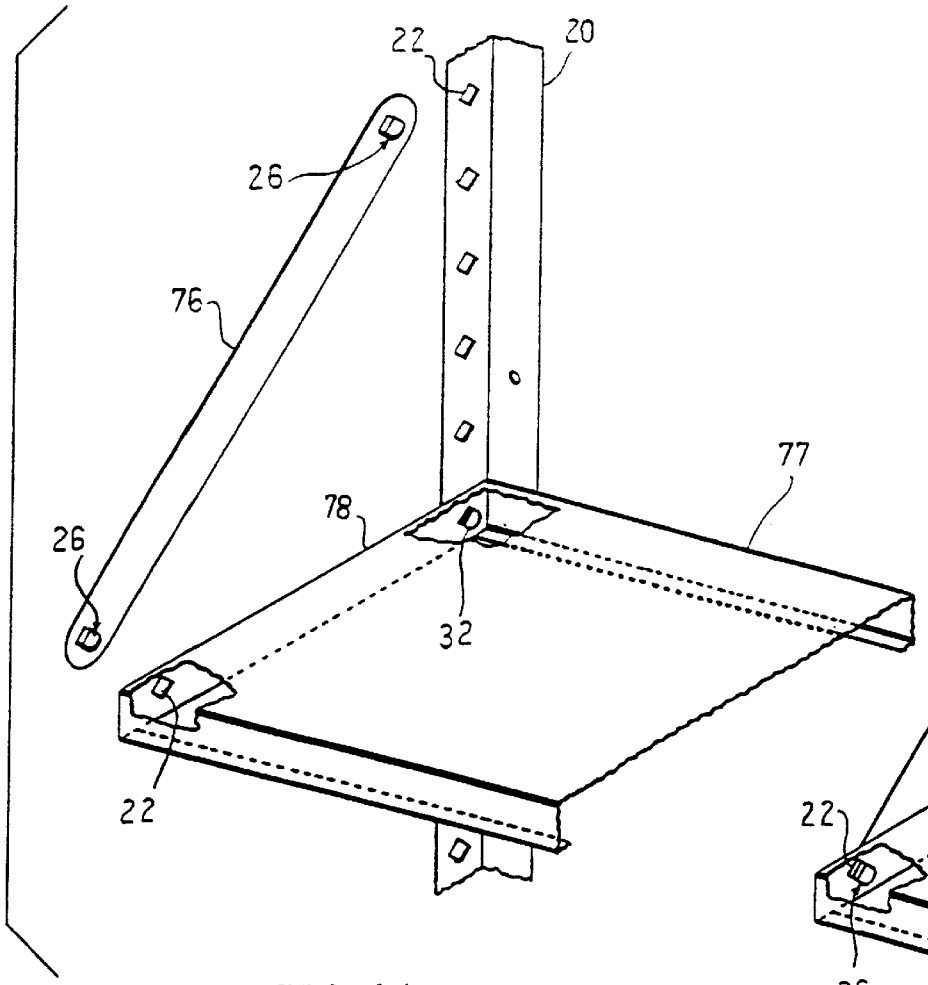

FIGS. 14*a–b* illustrate a shelf 77 with integrally formed tabs 26 and apertures 22, provided on each shelf end 78. Tab 26 on one end of bracing arm 76 engages aperture 22 on the font end of shelf end 78, and tab 26 on the rear end of shelf end 78 engages aperture 22 on upright 20, but this tab is not seen as in FIGS. 2*c–h.* Tab 26 on the other bracing arm 76 end engages upright 20.

Figures 15A, 15B, 15C:
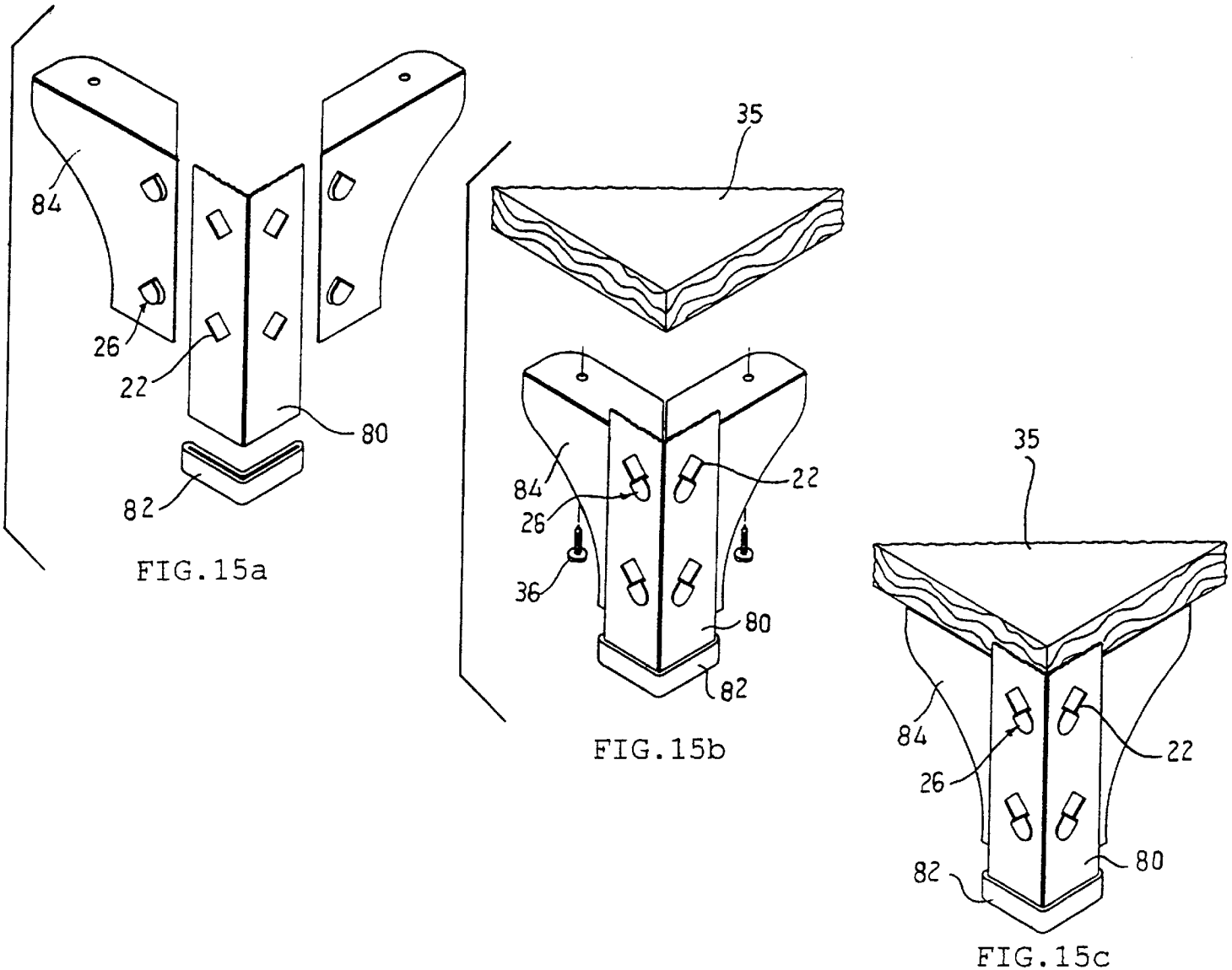
FIGS. 15*a–c* illustrate a free-standing corner upright design.

FIGS. 15*a–c* illustrate an alternative embodiment featuring a free-standing corner upright 80 designed with apertures 22 on both vertical surfaces, with a fitted cushion pad 82 attached at its bottom. Inverted shelf support brackets 84, shaped with a decorative lower edge, are similar to shelf supports 66 (FIGS. 11–*b*).

Figure 16:
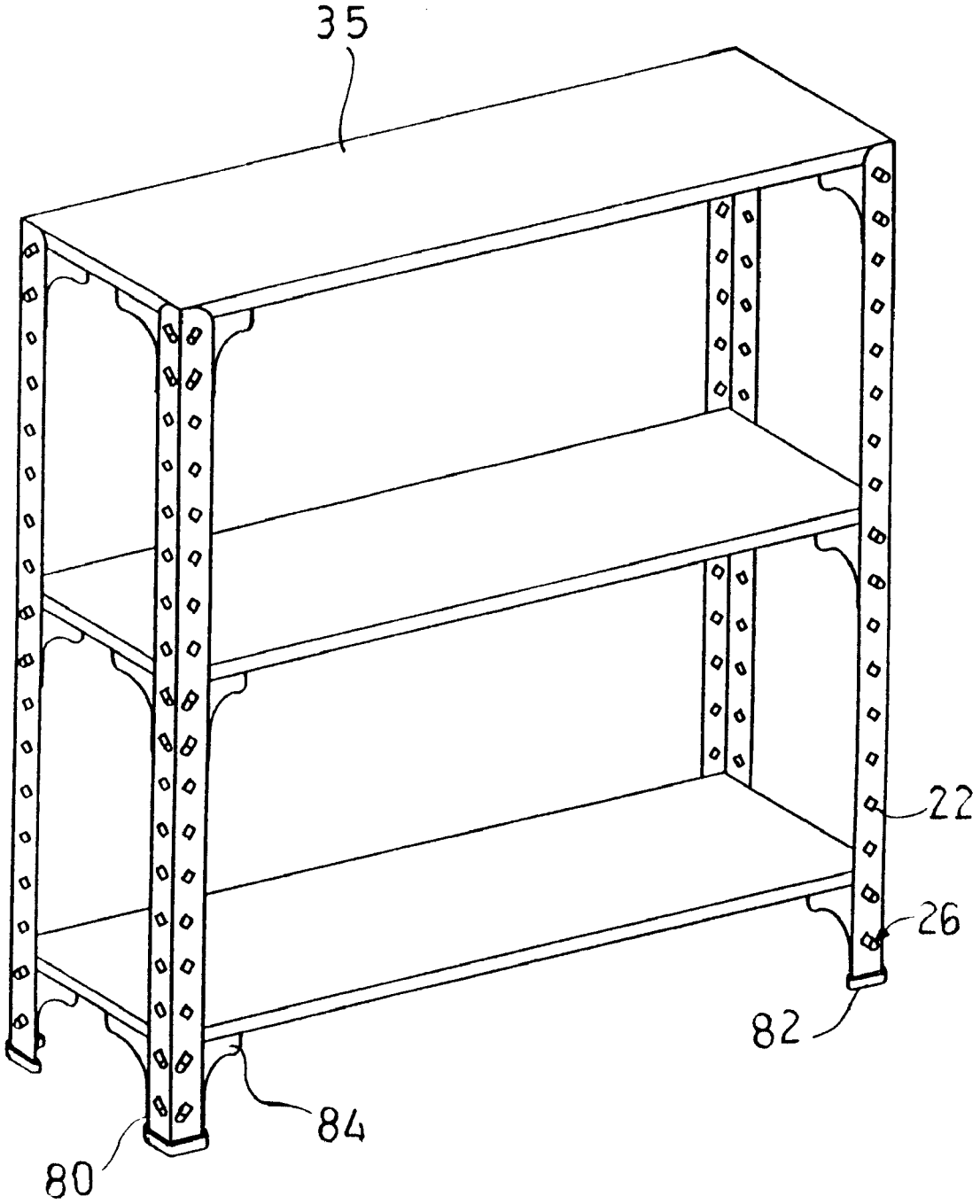
FIG. 16 illustrates a free-standing shelving assembly.

In FIG. 16, there is illustrated a free-standing shelving assembly which is constructed using the corner uprights 80 and inverted shelf supports 84 of FIGS. 15*a–b.* As with all of the previous embodiments, dimensions of this design may vary with the particular application, although standard sizes may be offered. The simplicity of assembly makes the free-standing unit especially useful in display and storage applications, since store personnel typically assemble these displays, and often rearrange them. Many different free-standing units can be made.

FIGS. 17*a–d* illustrate several shelf designs, of various materials, including metal, plastic with stiffening ribs, and an open wire mesh, with different mounting methods on modified shelf support brackets.

Figure 17A:
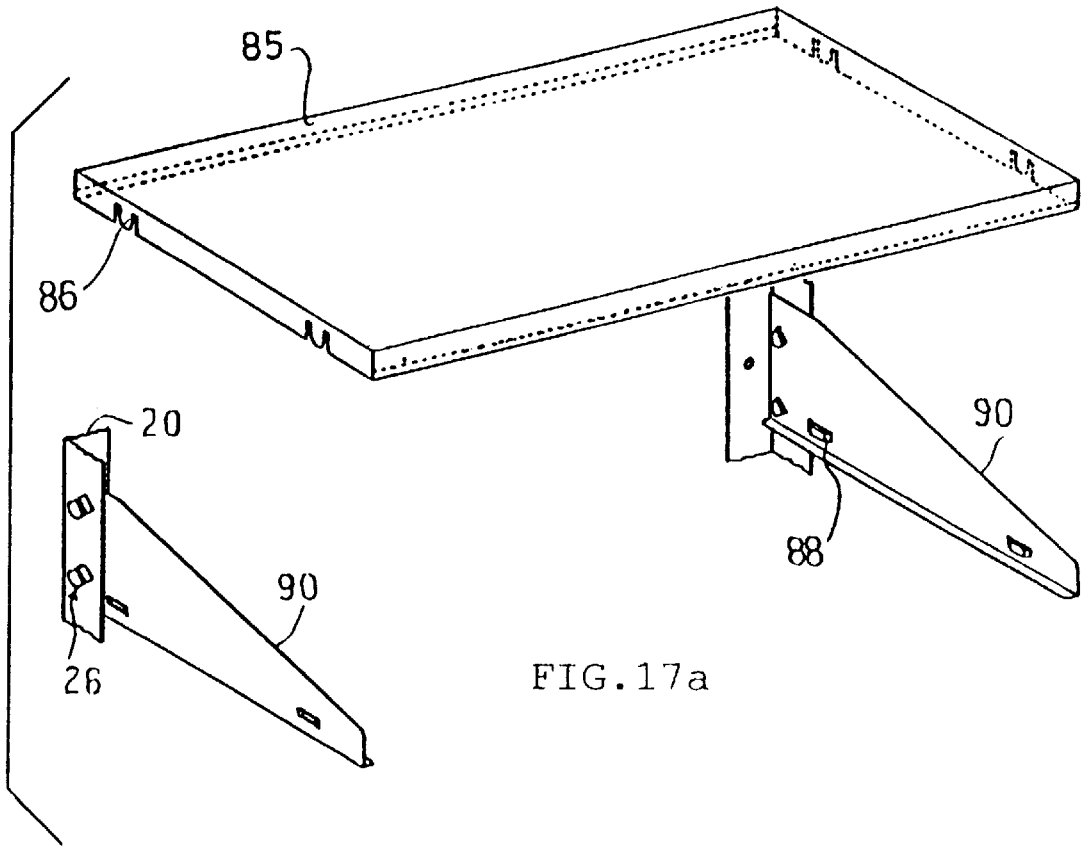
FIGS. 17*a–d* illustrate alternative materials for shelves.
Figure 17B:
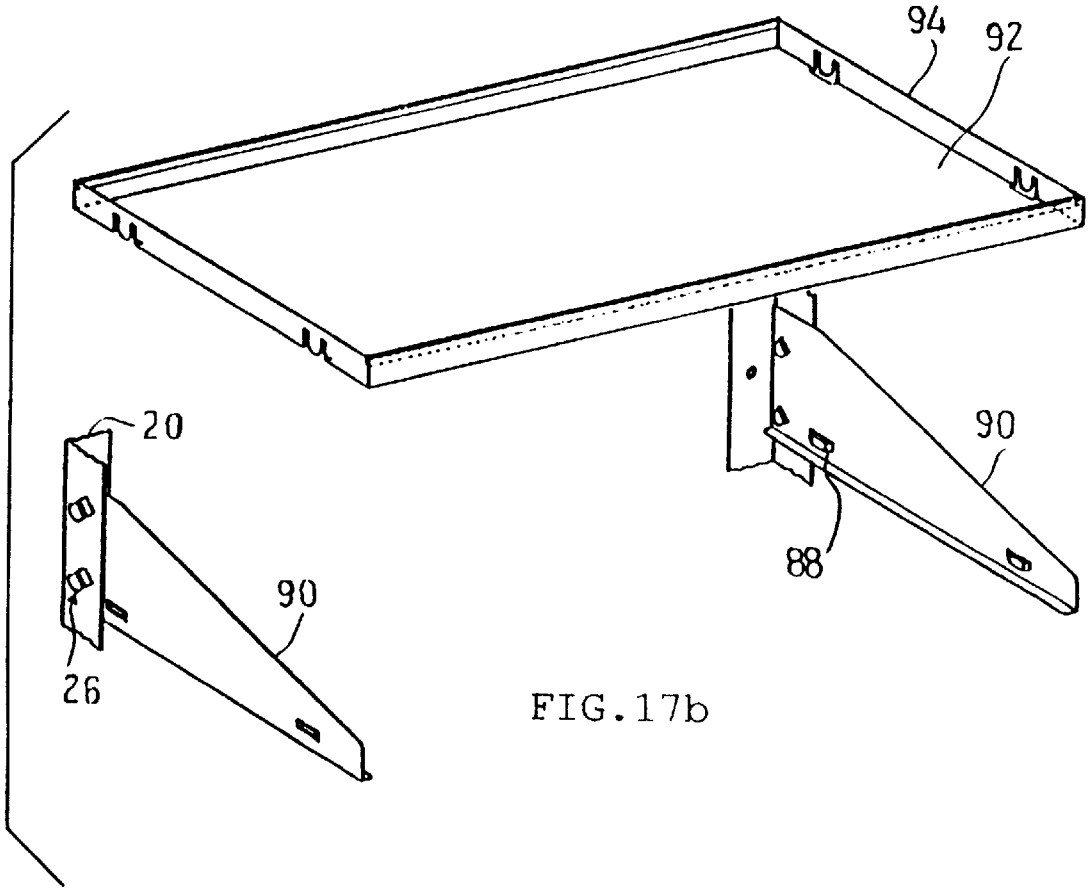
Figure 17C:
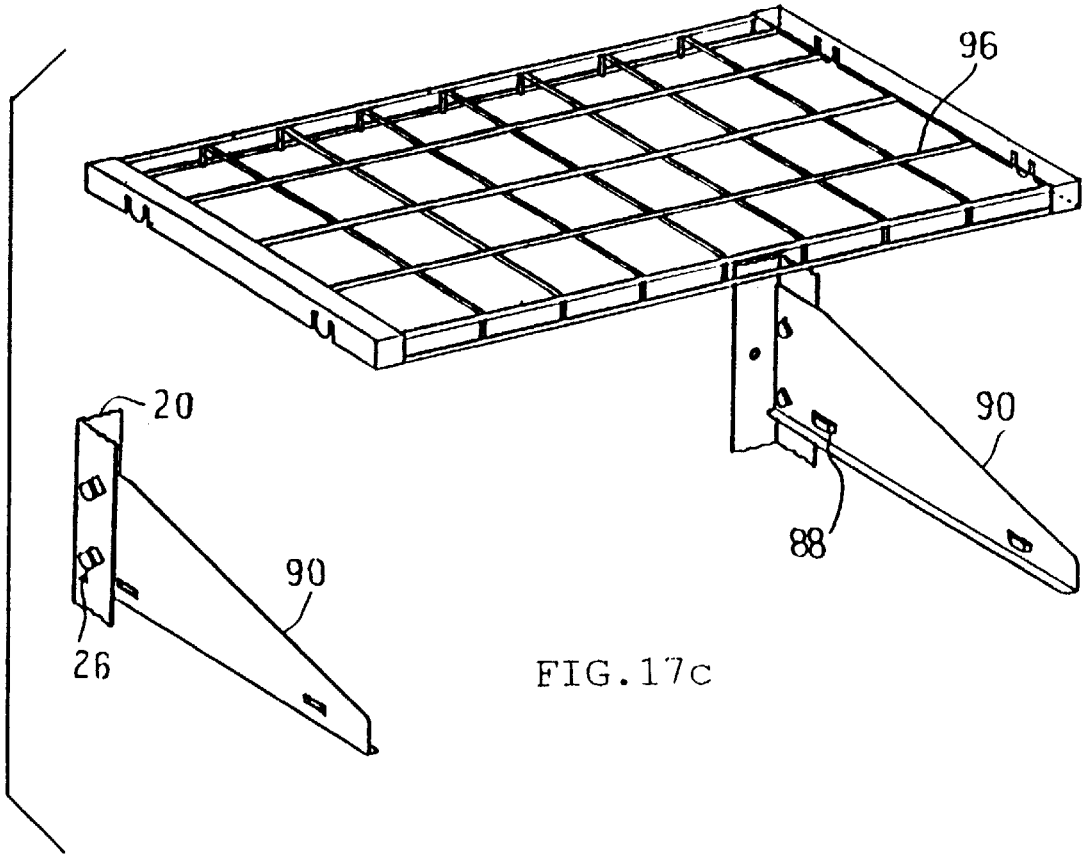

In FIGS. 17*a–c,* a utility sheet metal type of shelf 85 is formed with a pair of tongue-shaped flanges 86 on each of its ends, which are designed to engage a pair of stirrups 88 protruding from the vertical side of shelf support bracket 90.

An inverted sheet metal shelf 92 (FIG. 17*b*) may be designed for use in a hothouse for displaying potted plants, with the inverted shelf edges 94 providing a barrier inhibiting accidental spills.

An open wire mesh shelf 96 (FIG. 17*c*) may be useful for applications requiring good ventilation of shelf items.

Figure 17D:
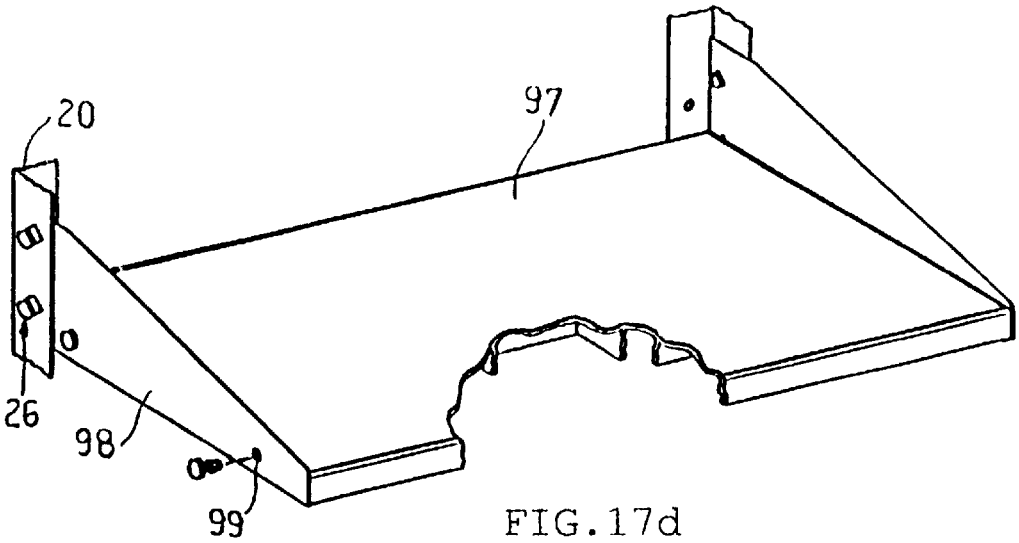

In FIG. 17*d,* a plastic shelf 97 with stiffening ribs is designed to be mounted on shelf support 98 by securing it with rubber or plastic mounting grommets passing through holes 99.

In summary, the inventive quick connect shelving assembly system features sturdy, easily constructed shelving units for homes, stores and offices. Many designs and layouts are possible.

Having described the invention with regard to the embodiments thereof, it is to be understood that the description is not meant as a limitation, since further modifications may now suggest themselves to those skilled in the art and it is intended to cover such modifications as fall within the scope of the appended claims.

What is claimed is:

1. A shelving assembly system comprising:

an upright member defining a vertical support having formed therein at least a first connecting means comprising a plurality of non-circular, closed apertures formed one above the other on said upright, and at least one shelf support having formed on its side face at least a second connecting means comprising a plurality of tabs each shaped to engage an edge of one of said apertures, said apertures being shaped to engage said first connecting means in locking fashion for supporting a shelf end thereon, wherein said first and second connecting means are oriented at an angle with respect to said upright member, said angle guiding engagement therebetween by combined horizontal and vertical motion, and wherein said tabs and apertures maintain locking engagement between said shelf support and said upright member, by developing oppositely-directed forces therebetween, when said shelf support is attached to said upright member in cantilever fashion, said oppositely-directed forces on the tabs at the aperture edges acting edge-on on the edges of said tabs, said forces being opposed by the shear strength associated with said tabs, enabling relatively high shelf loading.

2. The system of claim 1 further comprising a reinforcing clip formed on said shelf support to engage said upright member.

3. The system of claim 1 wherein said shelf support is shaped with tabs to engage non-adjacent ones of said apertures.

4. The system of claim 1 wherein said upright member comprises an L-shaped wall bracket having formed along at least one face thereof a plurality of said apertures.

5. The system of claim 1 wherein said upright member comprises a U-shaped intermediate wall bracket having formed along two faces thereof a plurality of said apertures, supporting a continuous run of shelving.

6. The system of claim 1 further comprising an intermediate shelf support attached to said shelf support to support a second shelf end in a continuous run of shelving.

7. The system of claim 1 further comprising a bracing arm for connection between said upright and a shelf end.

8. The system of claim 1 wherein said first connecting means comprises a tab and said second connecting means comprises a non-circular, closed aperture, said tab being shaped to engage an edge of said aperture.

9. The system of claim 1 wherein said shelf support is manufactured of light-gauge sheet metal.

10. The system of claim 1 wherein said shelf supports are provided in pairs at staggered heights in a shelving assembly.

11. The system of claim 1 wherein said shelf supports are provided in a free-standing shelving assembly.

12. The system of claim 1 wherein said shelf supports are provided in a closet organizer system comprising a modular unit having slidable drawers, a plurality of shelves and clothes hanger bar.

13. The system of claim 1 wherein each of said tabs has a shoulder which serves as a stop when it abuts said aperture edge during said diagonally-directed motion.

14. The system of claim 1 wherein said tabs are shaped to provide a gap which engages said aperture edge so as to limit side-to-side movement of said shelf support in relation to said upright.

15. The system of claim 1 wherein said apertures are rhombic-shaped, each being oriented at 45 degrees to the vertical.

16. The system of claim 15 wherein said engagement is achieved by placement of said tabs in said apertures first, said shelf support being locked via combined horizontal and vertical, diagonally-directed motion.

17. The system of claim 16 wherein said 45 degree orientation of said apertures insures self-locking attachment of said shelf support to said upright member, said diagonally-directed motion not being reversible by vertical motion.

18. The system of claim 15 wherein said 45 degree orientation of said apertures provides them in mirror-image locations on a pair of upright members, enabling use of a single type of upright member in left and/or right-handed shelf assembly.

19. A method of constructing a shelving assembly system comprising the steps of:

providing an upright member defining a vertical support having formed therein at least a first connecting means comprising a plurality of non-circular, closed apertures formed one above the other on said upright, providing at least one shelf support having formed on its side face at least a second connecting means comprising a plurality of tabs each shaped to engage an edge of one of said apertures, said apertures being shaped to engage said first connecting means in locking fashion for supporting a shelf end thereon, wherein said first and second connecting means are oriented at an angle with respect to said upright member, engaging said first and second connecting means, and providing said shelf support with diagonally-directed motion at said angle, locking said connecting means together, wherein said tabs and apertures maintain locking engagement between said shelf support and said upright member, by developing oppositely-directed forces therebetween, when said shelf support is attached to said upright member in cantilever fashion, said oppositely-directed forces on the tabs at the aperture edges acting edge-on on the edges of said tabs, said forces being opposed by the shear strength associated with said tabs, enabling relatively high shelf loading.

20. The method of claim 19 wherein first connecting means comprises a pair of rhombic-shaped apertures formed one above the other, and said second connecting means comprises a pair of tabs, said apertures each being oriented at 45 degrees to the vertical, said 45 degree orientation of said apertures insuring self-locking attachment of said shelf support to said upright member, said diagonally-directed motion not being reversible by vertical motion.

21. The method of claim 20 wherein each of said tabs has a shoulder which serves as a stop when it abuts said aperture edge during said diagonally-directed motion.

* * * * *